US006279448B1

(12) United States Patent
Thiesen

(10) Patent No.: US 6,279,448 B1
(45) Date of Patent: Aug. 28, 2001

(54) CARTRIDGE AMMUNITION AND METHOD OF MAKING THE SAME

(75) Inventor: Stefan Thiesen, Willich (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/157,951

(22) Filed: Sep. 22, 1998

(30) Foreign Application Priority Data

Sep. 23, 1997 (DE) ..... 197 41 841

(51) Int. Cl.[7] ..... F42B 33/02
(52) U.S. Cl. ..... 86/31
(58) Field of Search ..... 86/23, 29, 31, 86/20.13

(56) References Cited

U.S. PATENT DOCUMENTS 2,405,507 * 8/1946 Lefren ..... 86/23 X
2,775,987 * 1/1957 Bohlman et al. ..... 141/12
2,795,990 6/1957 Bohlman et al. .
2,807,975 * 10/1957 Bohlman et al. ..... 86/20.13
4,421,004 * 12/1983 Hallstrom et al. ..... 86/20.13
4,764,316 * 8/1988 Brown et al. ..... 264/3.1
5,335,599 8/1994 Thiesen et al. ..... 102/431
5,619,073 * 4/1997 Posey et al. ..... 264/3.3

FOREIGN PATENT DOCUMENTS 41 38 269 5/1993 (DE) .
492940 * 7/1919 (FR) ..... 86/20.13
582846 * 12/1924 (FR) ..... 86/20.13
808489 * 2/1937 (FR) ..... 86/20.13

* cited by examiner

*Primary Examiner*—Thomas Price
(74) *Attorney, Agent, or Firm*—Venable; Gabor J. Kelemen

(57) ABSTRACT

A method of making a cartridge ammunition includes the following steps: providing a cartridge case having a longitudinal axis; introducing bulk propellant powder into the cartridge case; and oscillating the cartridge case about its longitudinal axis for compacting the bulk propellant powder therein.

7 Claims, 2 Drawing Sheets

CARTRIDGE AMMUNITION AND METHOD OF MAKING THE SAME

CROSS REFERENCE TO RELATED APPLICATION

This application claims the priority of German Application No. 197 41 841.4 filed Sep. 23, 1997, which is incorporated herein by reference.

BACKGROUND OF THE INVENTION

This invention relates to cartridge ammunition and a method of making the same.

German Offenlegungsschrift (application published without examination) 41 38 269, to which corresponds U.S. Pat. No. 5,335,599, discloses a cartridge having a combustible cartridge case which, for increasing performance, has three partial charges: a high charge-density first partial charge which is a compressed propellant powder and which is disposed between the rear of the projectile and the cartridge base, a second partial charge which is a bulk propellant powder and which is situated at that side of the cartridge case which is oriented towards the projectile tip, and a third partial charge situated between the first and second partial charges. The third partial charge is a rod-shaped propellant which may also contain bulk propellant powder shaken into the space accommodating the rod propellant.

It is one of the disadvantages of the above-outlined known cartridge that the second partial charge, because of its low charge density, contributes only slightly—if at all—to the desired performance increase of the cartridge. Further, the compression of the first partial charge in the cartridge case leads to problems of reproducibility which is particularly disadvantageous when firing cartridges at low temperatures. Also, introducing the propellant into the known cartridge is a relatively time-consuming process.

SUMMARY OF THE INVENTION

It is an object of the invention to provide an improved method and cartridge of the above-outlined type in which the second partial charge too, significantly contributes to the performance increase of the cartridge.

This object and others to become apparent as the specification progresses, are accomplished by the invention, according to which, briefly stated, the method of making cartridge ammunition includes the following steps: providing a cartridge case having a longitudinal axis; introducing bulk propellant powder into the cartridge case; and oscillating the cartridge case about its longitudinal axis for compacting the bulk propellant powder therein.

Essentially, the invention is based on the principle to use a bulk propellant powder which is densely packed (compacted) by means of a rotary vibrator. The rotary vibrator is arranged in such a manner that its axis of rotation coincides with the longitudinal axis of the cartridge case. As a result of such a positional relationship, the vibrating process results in a parallelization of the longitudinal axes of the individual propellant powder grains with the longitudinal axis of the cartridge case, whereby a relatively high charge-density (packing density) of the propellant charge and thus a substantial performance increase of the cartridge are achieved.

Tests have shown that the frequency with which the rotary vibrator is oscillated is preferably between 0.2 and 10 Hz and the amplitude of the pivotal motion is between 10 and 270° in order to achieve the predetermined compactness of the bulk powder propellant charge in a relatively short time.

In accordance with an advantageous embodiment of the invention, a first partial charge is provided not by compression in the cartridge case, but as a stacked charge having a compactness which corresponds to that of a compressed partial charge. Since stacked charges may be very accurately made, the cartridges accordingly have a reproducible inner ballistic behavior even when fired at low temperatures. Further, by using such charges as separately deliverable components, an introduction of such charges into the cartridge may be performed in a short period of time.

According to another advantageous embodiment of the invention, the first partial charge too, is introduced into the cartridge case as a bulk propellant powder compacted by the rotary vibrator until the desired packing density is reached.

DESCRIPTION OF THE PREFERRED EMBODIMENTS

Figure 1:
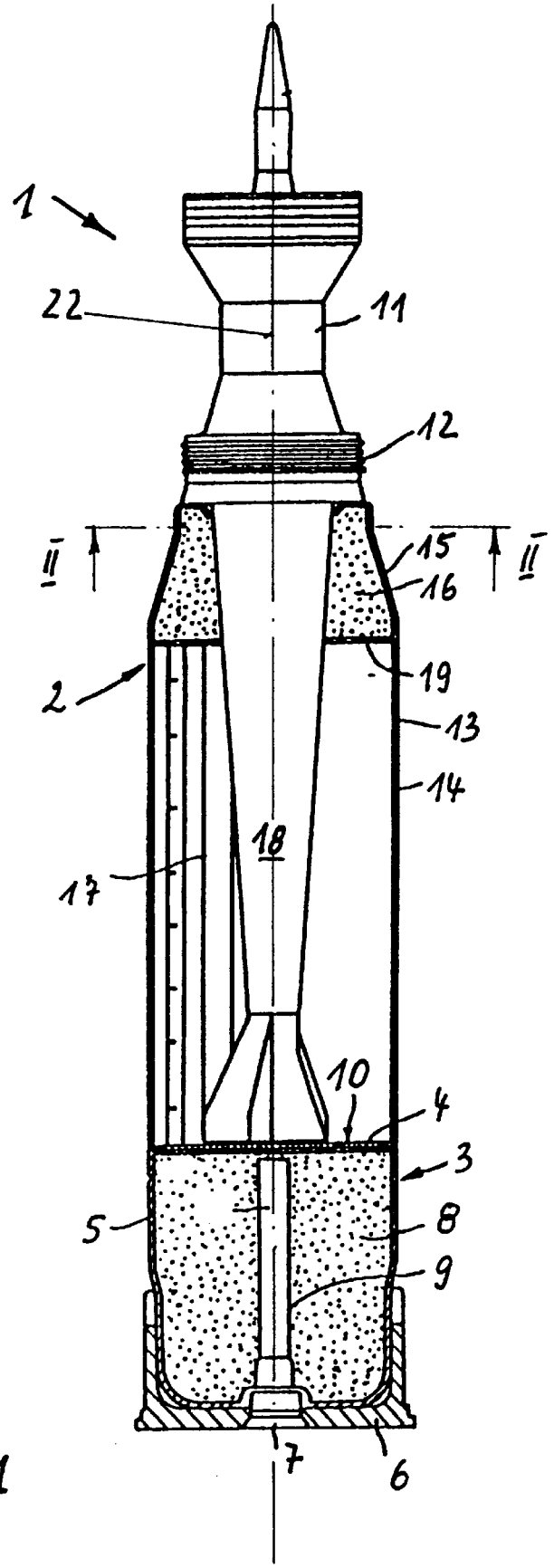
FIG. 1 is an axial sectional view of a two-part cartridge made according to the invention.

FIG. 1 shows a cartridge 1 having a frontal cartridge case part 2 and a rearward cartridge case part 3, separated from one another by a combustible disk 4 made, for example, of cardboard or textile fabric.

The rearward cartridge case part 3 is formed of a combustible component 5 secured to a metal case bottom 6, centrally supporting a bottom igniter part 7 by a threaded connection. The cartridge case part 3 accommodates a first partial charge 8 which is a stacked charge having a packing density corresponding to the compressed material ($\geqq 1.2$ g/cm$^3$) used in comparable cartridges (such as disclosed in the earlier-noted German Offenlegungsschrift 41 38 269). The first partial charge 8 defines an axial bore for receiving a metal ignition tube 9 which passes through the first partial charge 8 and which is supported on the bottom igniter part 7 to prevent it from lateral displacements.

The frontal cartridge case part 2 accommodates a fin-stabilized, subcaliber kinetic energy projectile 12 having a sabot 11 and extending to the bottom 10 of the frontal cartridge case part 2. The latter is formed of a combustible component 13 which has a cylindrical portion 14 and a frontal circumferential shoulder 15 whose forward end is inwardly crimped for providing an engagement face for the sabot 11. The frontal cartridge case part 2 accommodates, in the space surrounded by the shoulder 15, a second partial charge 16 which is a bulk propellant powder, compacted according to the invention by means of a rotary vibrator (not illustrated) to a packing density of between approximately 0.9 and 1.2 g/cm$^3$.

In the frontal cartridge case part 2, between the second partial charge 16 and the bottom plate 10, propellant rods are provided which constitute a third partial charge 17. The rods are packed closely to one another and extend over the length of the cylindrical portion 14. For filling dead spaces between the rods or between the rods on the one hand and the rearward part 18 of the projectile 12 on the other hand, and thus for increasing the packing density of the third partial charge, additionally bulk propellant may be shaken into those locations. Further, between the second and the third partial charges 16 and 17 a combustible apertured disk 19 is provided.

Figure 2:
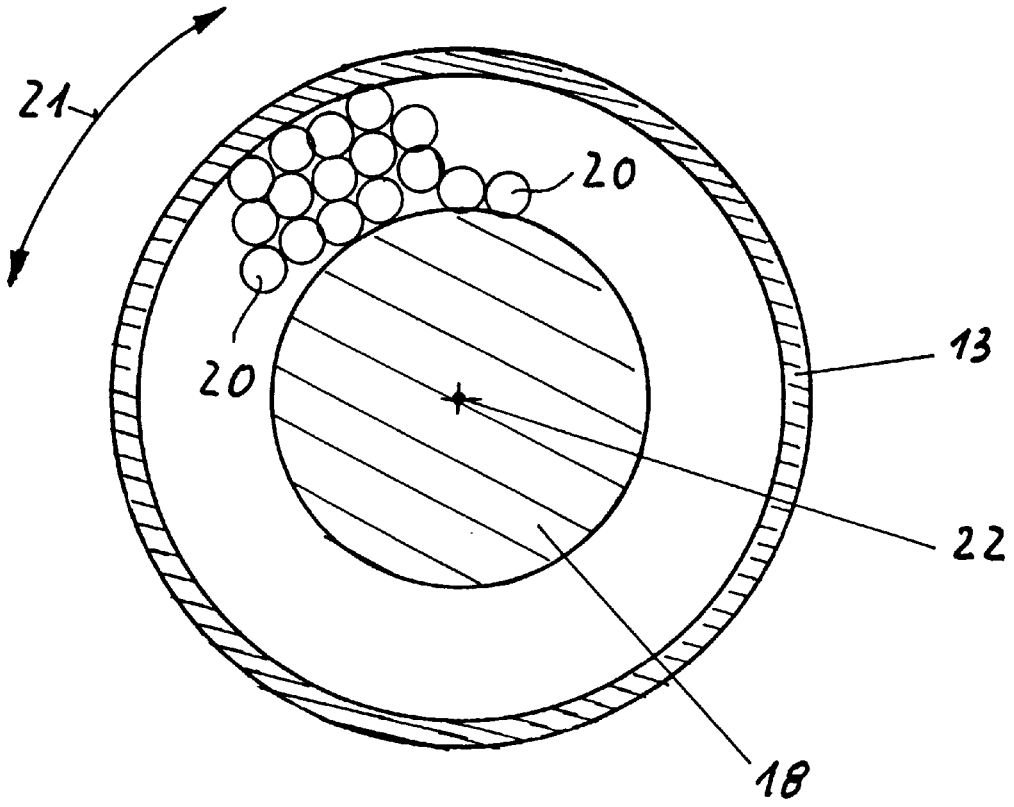
FIG. 2 is an enlarged sectional view taken along line II—II of FIG. 1.

In FIG. 2 the individual powder grains are designated at 20; arrow 21 indicates the direction of the oscillating motion of the cartridge during compacting of the propellant. Such an oscillating motion is performed about the longitudinal axis 22 of the cartridge with an amplitude of about approximately 150° at a frequency of preferably between 0.2 and 10 Hz.

In the description which follows a preferred embodiment of the method according to the invention will be set forth.

The kinetic energy projectile 12 is inserted into the frontal cartridge case part 2 to assume a position as shown in FIG. 1. At this stage, the frontal cartridge case part 2 has no propellant charges nor are the bottom plates 4 and 19 present. Also, the frontal cartridge case part 2 and the rearward cartridge case part 3 are not yet joined to one another.

Thereafter, the assembly formed by the frontal cartridge case part 2 and the kinetic energy projectile 12 is placed in a non-illustrated rotary vibrator so that the kinetic energy projectile 12 is pointing downward and the assembly axis 22 coincides with the rotary axis of the vibrator.

Then the rotary vibrator is set in motion such that the assembly 2, 12 is oscillated with an amplitude of between 10 and 270° and with a frequency of between 0.2 and 10 Hz. Simultaneously, bulk propellant powder is poured into the frontal cartridge part 2 from the top (that is, through the presently open bottom of the cylindrical part 14), whereby the bulk powder will build up in the space which is surrounded by the shoulder portion 15 and, by virtue of the forces imparted on the powder grains by the oscillation, the longitudinal axes of the grains will be aligned parallel to the assembly axis 22. Thus, the rotary vibrator causes a compacting of the bulk powder in the forward portion of the frontal cartridge case part 2, particularly in the space which is surrounded by the shoulder 15. Vibrating the assembly 2, 12 and pouring the bulk powder are discontinued when the predetermined amount of bulk powder has been placed into the frontal cartridge case portion 2 to thus constitute the second propellant charge 16.

As a next step, the perforated disk 19 is inserted in the frontal cartridge case part 2 and then the powder rods forming the third propellant charge 17 are positioned in the cylindrical portion 14 of the frontal cartridge case part 2. To fill out dead spaces, bulk powder may be shaken into the cylindrical part 14 to fill the spaces between the rods and between the rods and the cylindrical portion 14. It is also feasible to again oscillate the assembly 2, 12 in the above-described manner for compacting the bulk powder propellant occupying the cylindrical part 14.

Thereafter the combustible disk 4 is inserted to form the bottom of the frontal cartridge case part 2.

As a last step, the rearward cartridge case part 3 is secured to the frontal cartridge part 2, for example, by gluing. The rearward cartridge case part 3 was previously filled with the stacked charge forming the first partial charge 8.

According to an alternative, the pouring and vibrating step continues until the bulk powder substantially entirely fills the cylindrical portion 14 of the frontal cartridge case part 2 as well. In such a case then the rod-shaped propellant powder and the apertured disk 19 are omitted. Or, after the bulk powder has been compacted in the space surrounded by the shoulder 15, the apertured disk 19 is inserted and then the pouring and the vibrating step continues to fill the cylindrical space 14 instead of providing the powder rods.

As a further alternative which may be combined with either method concerning the filling of the frontal cartridge case part 2, instead of a stacked propellant charge, the first propellant charge 8 contained in the rearward cartridge case part 5 may also be a bulk powder, compacted by a rotary vibrator as described in connection with the frontal cartridge case part 2. Both alternatives contribute to an economic manufacture of the cartridge ammunition.

It is to be understood that the invention is not limited to the described example. Thus, the cartridge need not be a two-part structure; the invention may find equally advantageous application in one-part cartridges as well.

The packing densities of the partial charges should be preferably between 0.9 and 1.2 g/cm$^3$.

It will further be understood that the above description of the present invention is susceptible to various modifications, changes and adaptations, and the same are intended to be comprehended within the meaning and range of equivalents of the appended claims.

What is claimed is:

1. A method of making a cartridge ammunition comprising the following steps:

(a) providing a cartridge case having a longitudinal axis;

(b) introducing bulk propellant powder into said cartridge case; and (c) oscillating said cartridge case about said longitudinal axis for compacting said bulk propellant powder therein.

2. The method as defined in claim 1, wherein step (c) comprises the step of oscillating said cartridge case at an amplitude of between 10° and 270°.

3. The method as defined in claim 1, wherein step (c) comprises the step of oscillating said cartridge case at a frequency of between 0.2 and 10 Hz.

4. The method as defined in claim 1, further wherein step (a) comprises the step of providing an assembly formed of said cartridge case and a projectile inserted into said cartridge case.

5. The method as defined in claim 4, further comprising the step of inserting propellant powder rods into said cartridge case rearwardly of the compacted bulk propellant powder after step (c).

6. The method as defined in claim 1, wherein said cartridge case is a frontal cartridge case part; further wherein step (a) comprises the step of providing an assembly formed of said frontal cartridge case part and a projectile inserted into said frontal cartridge case part; further comprising the steps of (d) providing an assembly formed of a rearward cartridge case part having an igniter and accommodating a stacked propellant charge; and (e) securing said rearward cartridge case part to said frontal cartridge case part.

7. The method as defined in claim 1, wherein said cartridge case is a frontal cartridge case part; further wherein step (a) comprises the step of providing an assembly formed of said frontal cartridge case part and a projectile inserted into said frontal cartridge case part; further comprising the steps of (d) providing an assembly formed of a rearward cartridge case part having an igniter;

(e) introducing bulk propellant powder into said rearward cartridge case part;

(f) oscillating said rearward cartridge case part about said longitudinal axis for compacting said bulk propellant powder therein; and (g) securing said rearward cartridge case part to said frontal cartridge case part.

* * * * *